United States Patent [19]

Hodge

[11] 3,932,975

[45] Jan. 20, 1976

[54] BUILDING STRUCTURE AND COMPONENTS

[76] Inventor: John S. Hodge, 2350 Westridge Court, Ferndale, Mich. 48220

[22] Filed: Nov. 25, 1974

[21] Appl. No.: 527,137

Related U.S. Application Data

[63] Continuation-in-part of Ser. No. 340,595, March 12, 1973, Pat. No. 3,861,102.

[52] U.S. Cl. ..... 52/282; 52/301

[51] Int. Cl.[2] ..... E04B 2/72

[58] Field of Search ..... 52/281, 282, 284, 285, 52/286, 270, 300, 234, 236, 301, 57, 280

[56] References Cited

UNITED STATES PATENTS

| | | | |
|---|---|---|---|
| 826,996 | 7/1906 | Cooke | 52/301 X |
| 1,356,319 | 10/1920 | Smulski | 52/234 X |
| 2,057,018 | 10/1936 | Dillon | 52/300 X |
| 2,839,790 | 6/1958 | Collings | 52/595 X |
| 3,220,773 | 11/1965 | Burns | 52/282 X |
| 3,299,594 | 1/1967 | Kellert | 52/284 X |
| 3,350,824 | 11/1967 | Wiebusch | 52/282 X |
| 3,423,891 | 1/1969 | Burris | 52/282 X |
| 3,566,561 | 10/1968 | Tozer | 52/282 X |
| 3,842,557 | 10/1974 | Brown | 52/301 |

*Primary Examiner*—Price C. Faw, Jr.
*Attorney, Agent, or Firm*—Lon H. Romanski

[57] ABSTRACT

A building structure of either single or multi-story construction employs wall panels and columns each of which may be fabricated as at a factory and transported to the building site and there erected in a generally modular mode of operation.

24 Claims, 13 Drawing Figures

BUILDING STRUCTURE AND COMPONENTS

RELATED APPLICATION

This application is a continuation-in-part of my copending application Ser. No. 340,595 filed Mar. 12, 1973, for BUILDING STRUCTURE, now U.S. Pat. No. 3,861,102.

BACKGROUND OF THE INVENTION

Presently there is a need for what may be termed low cost housing and buildings. The building and construction industry has attempted to solve such problems by deliberately reducing the overall quality of such structures to the absolute minimum acceptable standards. However, in so doing, whatever savings in money are realized are those which are primarily attributable to the cost of materials employed and the elimination of certain features which, although desirable, are not considered essential to the utility of the overall structure.

The reason that savings are limited to such areas is because the employment of skilled tradesmen, at the construction site, for the cutting and fitting of the various components requires the payment of the same hourly rate of pay even though the resulting structure may be considered "low cost."

There have been other attempts to reduce costs as by the construction of prefabricated structures within a factory and then transporting such prefabricated structure to its intended site. However, this method requires the expense of moving such prefabricated structures (with attendant possibilities of damage thereto) and is further limited to the construction of prefabricated structures which can be physically accommodated within the factory.

Further, prior art attempts at mass production of building structures, as by prefabrication of component portions thereof, have generally followed the basic building practices heretofore established for many years. That is, the conventional wall plates, wall studs, sheeting, exterior siding and interior wall finishing are employed for constructing the prefabricated component portions. Except for a few basic departures, most of which employ the geodesic principle resulting in dome-like configurations, the prior art has not made any significant attempts to combine the advantages of easily and quickly erectable structures with the concept of minimizing the required material for building such structures as by developing component configurations which will maximize the stress carrying capabilities of such components.

Accordingly, the invention as herein disclosed and described is primarily directed to the solution of the above and other attendant problems.

SUMMARY OF THE INVENTION

According to the invention, a building structure comprises a plurality of spaced vertically extending support columns, a plurality of separate wall panels respectively situated between said spaced support columns, and means operatively interconnecting said plurality of columns as to thereby result in structural integrity of said columns and said wall panels.

Various general and specific objects and advantages of the invention, among which is the ability to manufacture standardized type of components in a factory and then without assembly ship such components to the building site, will become apparent when reference is made to the following detailed description considered in conjunction with the accompanying drawings.

BRIEF DESCRIPTION OF THE DRAWINGS

In the drawings, wherein for purposes of clarity certain elements or details may be omitted from one or more views.

DETAILED DESCRIPTION OF THE PREFERRED EMBODIMENTS

Figure 1:
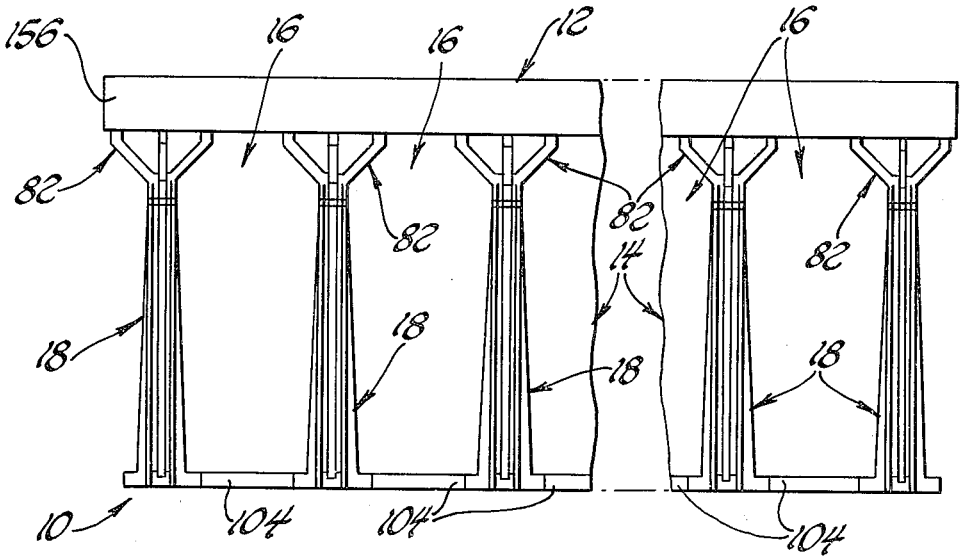
FIG. 1 is a side elevational view of a building structure embodying the teachings of the invention.
Figure 2:
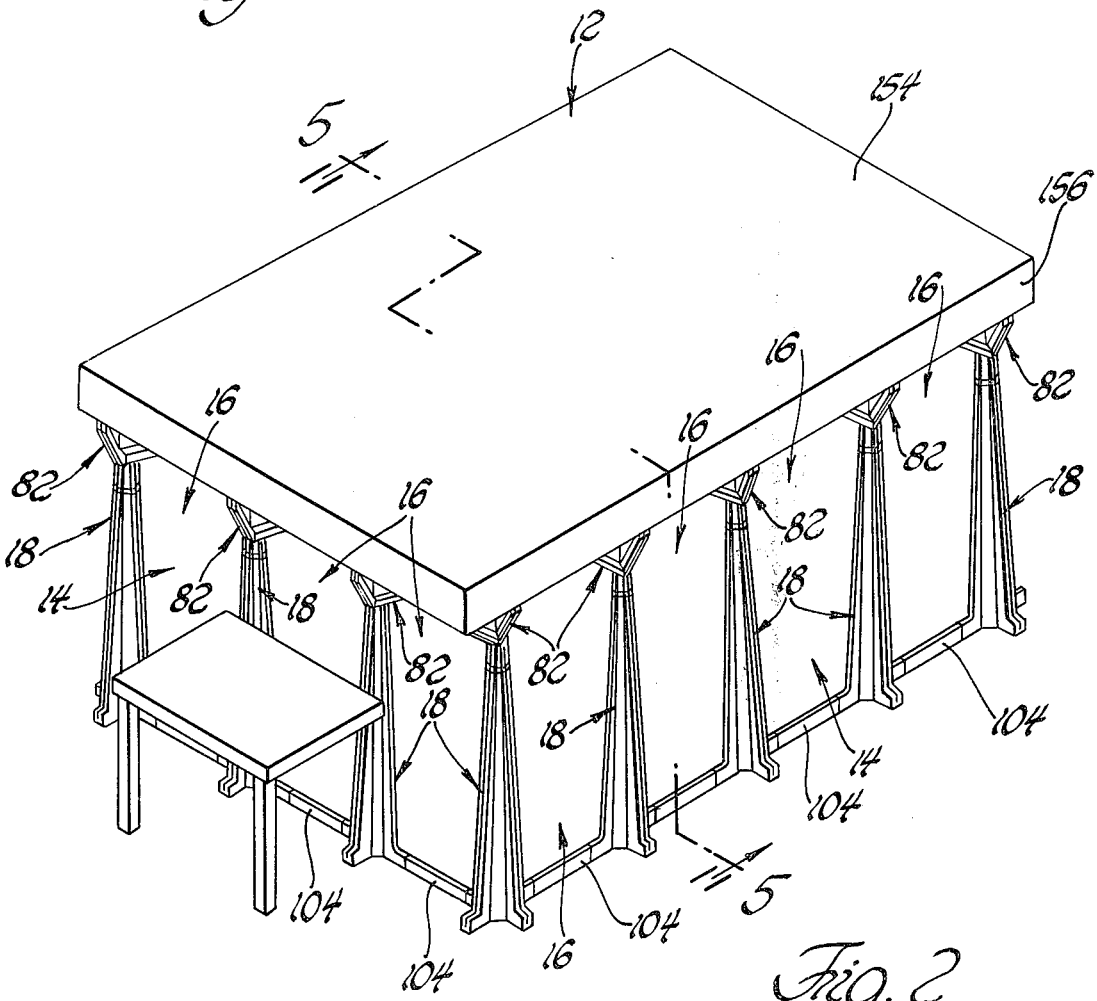
FIG. 2 is a perspective view of the structure of FIG. 1.

Referring now in greater detail to the drawings, FIG. 1 illustrates, in side elevational view a building or structure 10 embodying and teachings of the invention with FIG. 2 being a perspective view of such structure with the addition thereto of, for example, a suitable roof over the entry to such building.

Generally, the structure 10 is illustrated as being comprised of a roof 12 supported as by vertically extending wall assemblies 14 which, in turn, are comprised of cooperating alternating wall panels 16 and columns or posts 18 with such columns 18 being employed within the run of the wall assembly and as corner columns or posts.

Figure 3:
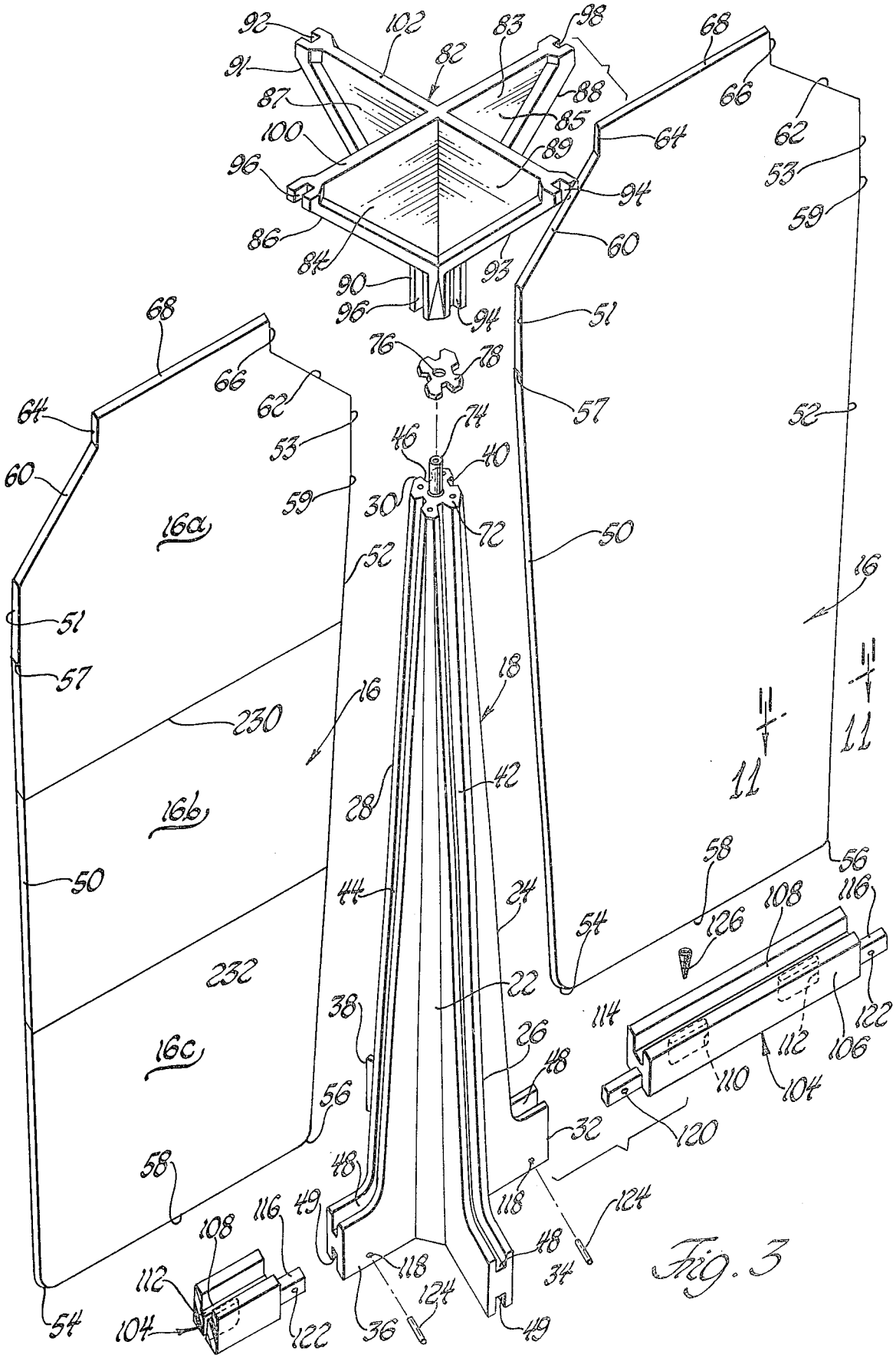
FIG. 3 is an enlarged exploded view of certain of the elements shown in each of FIGS. 1 and 2.

FIG. 3 illustrates in exploded perspective view the general manner of assembly and interrelationship of the elements shown in FIGS. 1 and 2. As can be seen, in the preferred embodiment columns 18 are comprised of a main vertically extending body portion 22 preferably having axially aligned legs or rib-like means 24, 26, 28 and 30 formed integrally therewith and angularly spaced thereabout as, for example, at 90° intervals. Legs 24, 26, 28 and 30 respectively terminate in a base portion comprising, for example, aligned foot-like portions 32, 34, 36 and 38. Further, grooves or recesses 40, 42, 44 and 46 are respectively formed in legs 24, 26, 28 and 30 in a manner as to extend downwardly into the respective aligned foot portions 32, 34, 36 and 38. As typically illustrated in FIG. 5, such grooves preferably terminate in a generally horizontally or laterally extending open-ended slot portion 48 formed in each of the foot portions.

Wall panel means 16 are preferably of a generally trapezoidal configuration having opposed slanting side wall edges 50 and 52 terminating at their lower ends in arcuate corners 54 and 56 each blending into a lower edge 58. At the upper end of each panel 16, oppositely sloping edges 60 and 62 extend generally upwardly as to meet generally vertically extending wall edges 64 and 66 which, in turn, terminate in an upper panel edge 68. As also illustrated, the panel means 16 are formed as to have, at opposite edges thereof, vertically extending surfaces 51 and 53 as to have edge 50 terminate in the lower end of surface 51 while the lower end of upper edge 60 terminates in the upper end of surface 51. Similarly, surfaces or edges 62 and 52 terminate in vertical surface or edge 53.

The top of each column 18 is preferably truncated, as at 72, and provided with an upwardly extending location member 74 which is received through an aperture 76 formed in a seal 78 as well as received within a cooperating aperture 80 formed in a capping or filler plate member 82.

As shown in the preferred embodiment, the capping member 82 may be comprised of a panel-like body portion 83 having transversely extending generally triangular panel or arm sections or portions 84, 85, 87 and 89 respectively provided with upwardly extending and outwardly directed boundarylike edge portions 86, 88, 91 and 93 which, at their respective lower ends, terminate in what may be referred to as an extension 90 of column 18. The extension 90 has opposed grooves 92 and 94 formed therein which respectively align with grooves or recesses 46 and 42 of column 18 and a second set of opposed grooves or recesses 96 and 98 which respectively align with grooves 44 and 40 of column 18. Such grooves 96, 98, 92 and 94 also respectively continue upwardly coextensively with edge portions 86, 88, 91 and 93 as to each terminate in an open end opening in the upper edge surfaces 100 and 102.

Figure 5:
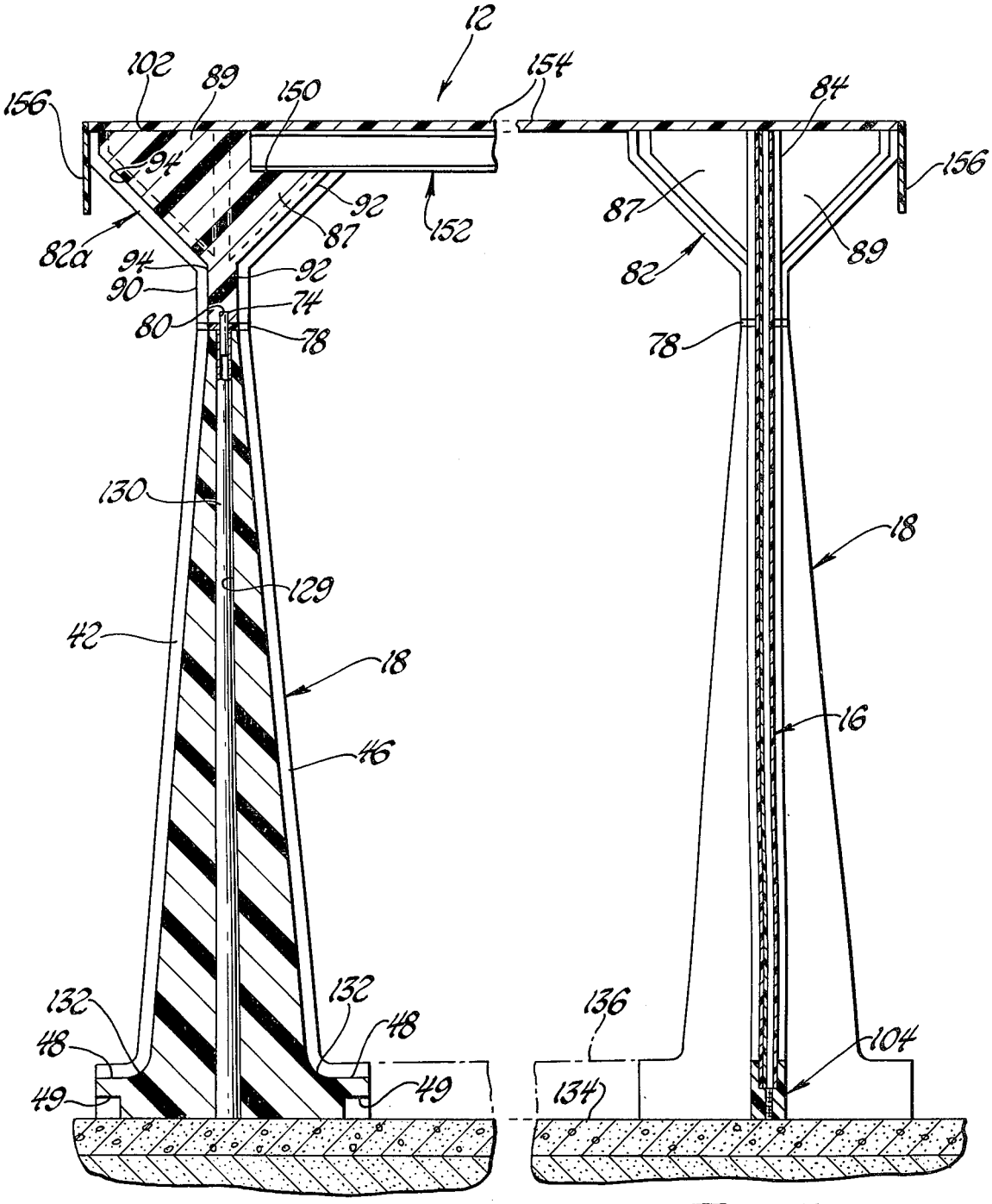
FIG. 5 is a cross-sectional view taken generally on the plane of line 5—5 of FIG. 2 and looking in the direction of the arrows.

As also shown in FIG. 3, lower connecting or base members 104 are preferably provided so as to both receive therein a portion of the cooperating wall panel 16 and to join succeeding columns 18 to each other. As typically illustrated, such base members 104 may be comprised of a main body 106 having a longitudinally extending slot or groove 108 formed therein with elongated slots or apertures 110 and 112 formed therethrough and opening into such groove 108. Further tongue-like extensions 114 and 116 are provided at opposite ends of the body 106 as to be generally aligned with slot 108. However, as shown, in the preferred embodiment the upper surfaces of extensions 114 and 116 are considerably below the level or elevation of the lower surface of slot 118 so as to be generally stepped down therefrom. By so doing the base or foot portions of the columns 18 may be additionally strengthened by requiring the formation of a lower disposed slot or recess 49, in such foot portions, for the reception of the cooperating tongue-like extensions. With reference also to FIG. 5, extensions 114 and 116 are of a length as to be receivable within slots 49 formed in the foot portions of columns 18 while the inner-most longitudinal surface of groove 108 is at a higher elevation substantially equal to the elevation of cooperating groove portions 48 formed within the same foot portions. As best seen in FIG. 3, at least selected ones of the column foot portions are provided with a through aperture 118 while extension 114 has an aperture 120 formed therethrough and extension 116 has an aperture 122 formed therethrough.

Generally, in assembling a building embodying the invention, base columns 18 and base members 104 may be first assembled, atop any suitable support means, as by having the extensions 114 and 116 received by the slots 49 of the foot portions. For example, still referring to FIG. 3, one of the bases 104 would have extension 116 received in slot 49 of foot 36 thereby placing its groove 108 in line with grove 44, and its general lateral extension groove 48, so as to form a continuation thereof while the other shown base 104 would have its extension 114 received in slot 49 of foot 32 thereby placing its groove 108 in registry with corresponding groove portion 48 and upwardly extending groove 40 so as to form a continuation thereof. When bases 104 are thusly assembled to foot portions 36 and 32, suitable pins, bolts or any other effective retaining means, such as at 124, are inserted respectively through then aligned holes 118, 122 and 118, 120 thereby securing the bases 104 to the intermediately located column 18 and making such components into a unitary structure. Of course, succeeding columns and bases are similarly interconnected as to form the continuous wall 14.

As the columns 18 and bases 104 are connected to each other some relative movement may be necessary as between coacting column and base. Since in the preferred embodiment bases 104 are secured to a lower support surface, as by fastening means 126 extending through slots 110, such slots 110 are elongated to enable the movement of such bases 104 relative to the said lower support surface and whatever anchoring means may be provided therein for coaction with said fastening means 126.

In the preferred sequence of operations, the various components are assembled as follows. That is, for example, bases 104 are secured to respective columns 18 and all of such are secured to the supporting footings. Then wall panel means 16 are placed, or slid into place from above, as by having one panel edge 52 slide into groove 44 of one column 18 and panel edge 50 slide into groove 40 of the next adjacent column 18 until the lower edge 58 of panel 16 is seated into outwardly directed groove portions 48 in the respective foot portions 36 and 32 of such cooperating succeeding columns 18 as well as being seated in groove 108 of the cooperating lower disposed base member 104. After the wall panel means 16 are thusly assembled, the capping or extension members 82 are assembled atop the respective columns 18 in a manner whereby vertical edges 53 are 51 are slidably received within the cooperating oppositely disposed vertically extending grooves formed in extension portion 90 of the capping member 82. When the capping member 82 is thusly seated, edges 66 and 62 of one panel 16 as well as edges 60 and 64 of the other panel 16 are received within cooperating grooves of capping member 82.

It should be observed that preferably the place of juncture between extension 90 and column 18 is at an elevation generally equivalent to the elevation of corner 57 (defined by edges 50 and 51) and corner 59 (defined by edges 52 and 53). Consequently, the strength of the panel 16 thusly received enhances the rigidity of the assembly composed of column 18 and capping member 82. When the elements are assembled as described, the upper end surface 100 of member 82 and upper end surface 68 of wall panel 16 are placed in functional alignment with each other.

Figure 4:
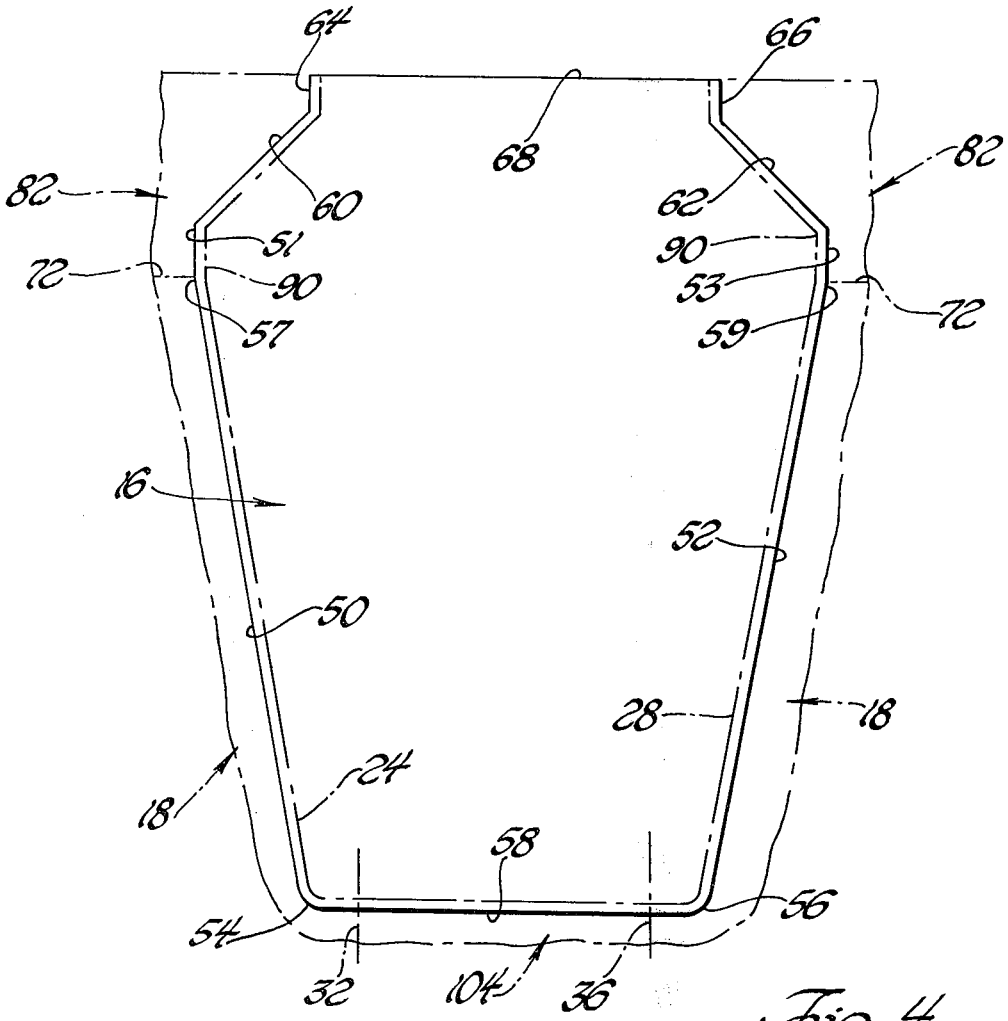
FIG. 4 is a side elevational view of one of the elements shown in FIG. 3.

As illustrated in FIG. 4, wherein the panel means 16 is shown in solid line while adjoining columns 18, base member 104 and capping members 82 are shown in phantom line, surfaces 51 and 53 are generally parallel to each other and parallel to the vertical axis of the adjoining columns 18 so that such wall panels 16 and capping members 82 may be readily and easily vertically assembled, from above, into and onto the positioned columns 18. As generally depicted, it can be seen that panel edges 64, 60 and 51 are respectively received within groove or recess 98 or the left-most capping member 82, panel edges 66, 62 and 63 are respectively received within groove or recess 96 of the right-most capping member 82, panel side edge 50 and a portion of corner 54 are received in groove or recess 40 of left-most column 18, panel side edge 52 and a portion of corner 56 are received in groove or recess 44 of right-most column 18, a portion of corner 54 and a portion of panel bottom edge 58 are received in groove portion 48 (continuation of groove 40), a portion of corner 56 and a portion of panel bottom edge 58 are received in groove portion 48 (continuation of groove 44 of right-most column 18), while the remainder of bottom edge 58 of panel 16 is received in groove 108 of interconnecting base member 104.

It should be apparent that in order to prevent water seepage (as might occur during a rain storm) and to prevent or at least minimize air leakage through such a wall assembly, it is preferred to have the various grooves and cooperating edges of the various components of respective dimensions resulting in tight engagement therebetween.

FIG. 5, a cross-sectional view taken generally on the plane of line 5—5 of FIG. 2, illustrates, on the left side, a column 18 and filler or capping plate 82 in axial cross section while on the right side, the plane of cross section is taken along the vertical median of a wall panel 16. Regardless of whether the columns 18, as in one contemplated embodiment of the invention, are constructed of concrete or of plastic, it becomes highly desirable to reduce the weight thereof as much as possible consistent with structural strength and integrity. This may be done, for example, by having a hollow core 129 (preferably tapered) formed as by an axially extending paper-like tube 130. The upper end of tube 130 may serve an additional function, if desired, as by being of a dimension as to closely or tightly receive the locating pin 74 therein. As typically illustrated, each of the longitudinal grooves in the column 18 is preferably provided with a radiused portion 132 blending with the continuation 48 of such recess or groove within the respective foot portion. The primary purpose of such curvelinear portions 132 is to closely conform to the rounded corners 54 and 56 of wall panels 16 when such are assembled to the columns 18.

As generally illustrated in FIG. 5, the columns 18 and bases 104 may be situated atop a concrete slab 134. However, the practice of the invention is not limited merely to its use in combination with such a slab. That is, for example, suitable foundation type footings may be formed for the placement thereatop of such columns and bases while a floor as generally shown in phantom line at 136 may be poured between such columns and bases.

Figure 6:
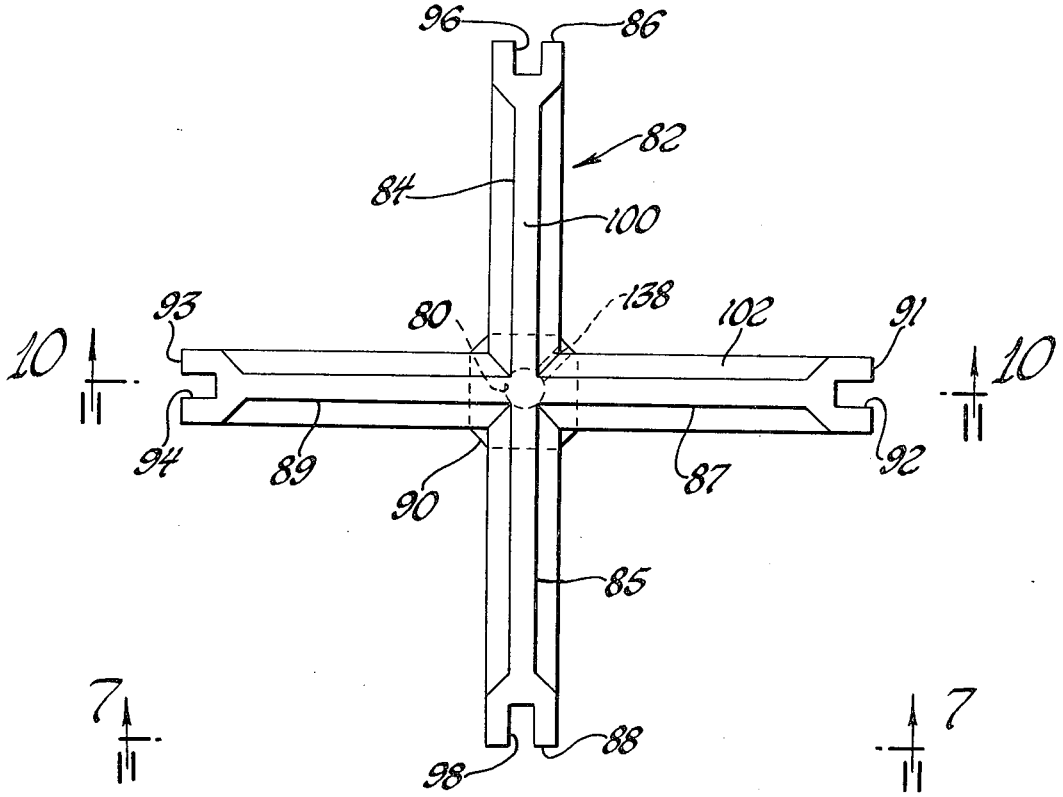
FIG. 6 is an enlarged top plan view of one of the elements shown in FIG. 3.
Figure 7:
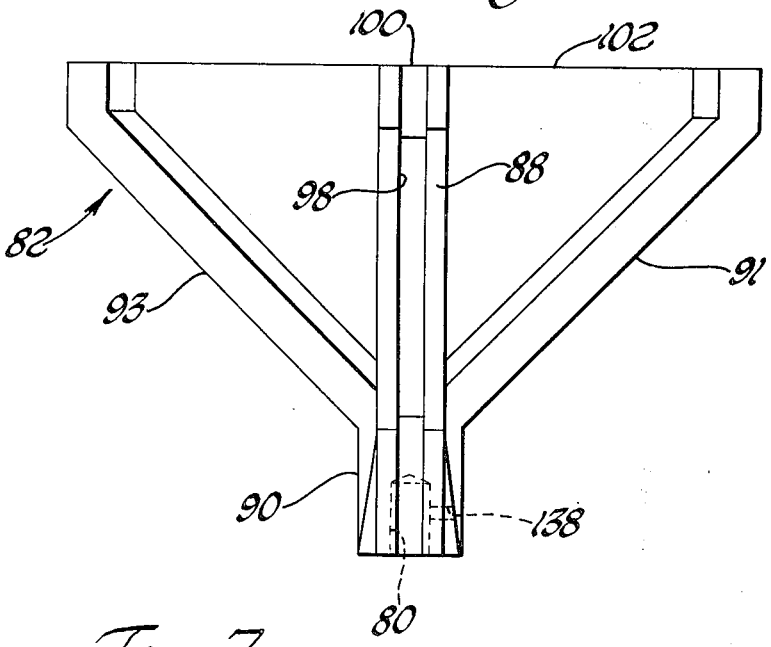
FIG. 7 is a side elevational view of the structure shown in FIG. 6 taken generally on the plane of line 7—7 of FIG. 6 and looking in the direction of the arrows.

FIGS. 6 and 7 illustrate, in enlarged scale, the capping member 82 of previous Figures. As best shown in FIG. 7, the locating recess or aperture 80 may have a second passageway of opening 138 communicating therewith. The purpose of such passageway 138 is to provide access means for the introduction therethrough of a suitable adhesive, welding or cementing agent, after the capping member or filler plate 82 is placed atop the column 18, as depicated generally by FIGS. 2 or 5, in order to thereby bond the various coacting components and form a more unitary structure which is for all practical purposes free of any seams which might permit water or moisture passage therethrough.

Figure 8:
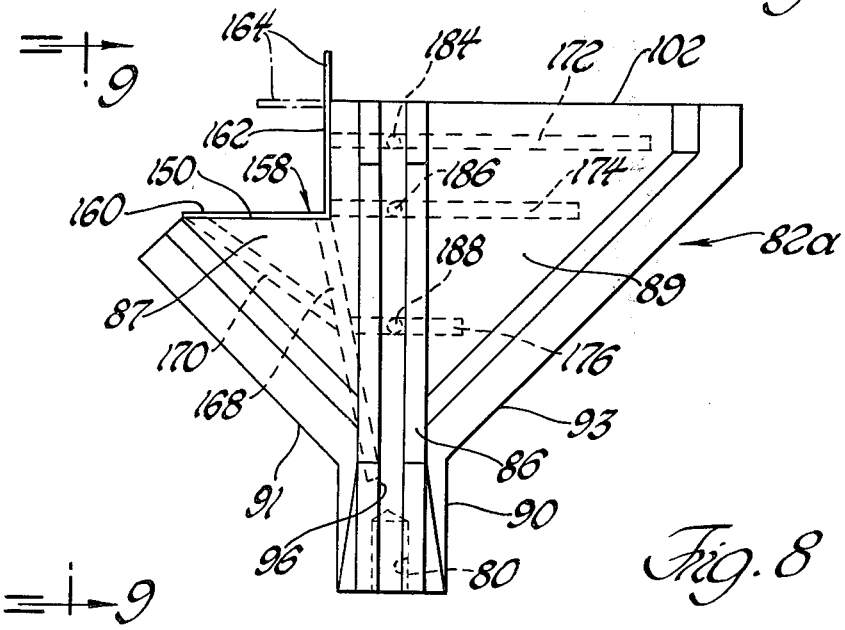
FIG. 8 is a side elevational view of one of the elements shown in FIG. 5.

FIG. 8 illustrates a somewhat modified embodiment 82*a* of the capping member 82. With additional reference to FIG. 5, it can be seen that the main difference between capping member 82 and capping member 82*a* resides in the cutting away or otherwise forming a lower step-like support surface 150 as in body section 87.

As generally depicted in FIG. 5, the support surface 150 may then receive thereon, in supporting relationship, one end of a roof supporting member such as an I-beam 152. The I-beam 152, in turn, provides support as for horizontally disposed roof panel means 154 comprised of any suitable material such as, for example, plastic. As shown in FIG. 5, the roof panel means 154 preferably extend as to also rest on and be supported by the portion of upper edge 102 carried atop body section 89. If desired, suitable facia 156, which may also be formed of any suitable material, is carried generally externally of body section 89.

Figure 9:
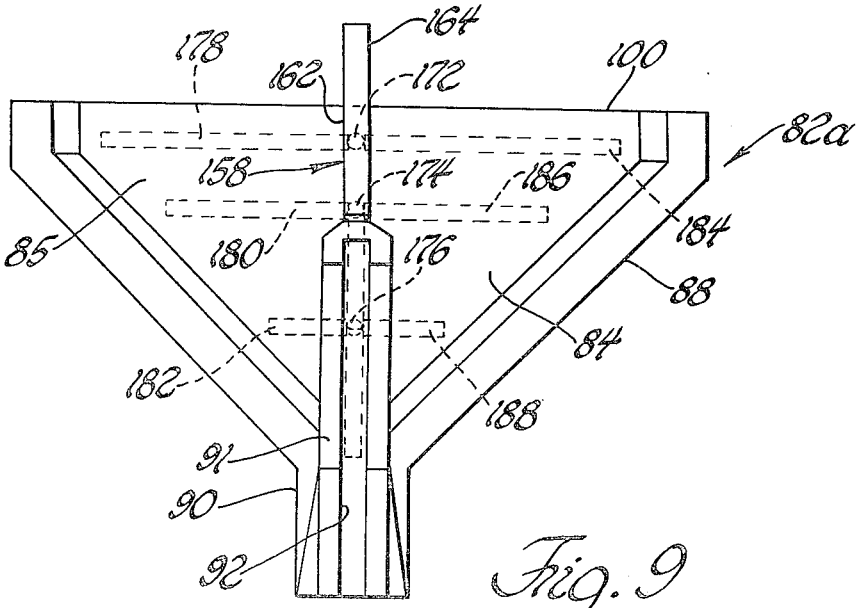
FIG. 9 is a view taken generally on the plane of line 9—9 of FIG. 8 and looking in the direction of the arrows.

FIGS. 8 and 9 illustrate another embodiment of the capping member 82*a* of FIG. 5. That is, such capping member 82*a* may be further modified as generally disclosed by FIGS. 8 and 9. For example, cut-out 150 may be provided with, for example, a steel bracket-like member 158 having legs 160 and 162. When a roof joist or some such equivalent member is situated atop bracket leg 160, the upwardly extending leg 162 would have its upper portion 164 bent over, as to engage the top of such roof joist, and secured thereto as generally indicated in phantom line.

Further, to enhance the weight carry capability of the capping member 82*a*, an internally disposed reinforcing framework is provided. For example, referring to FIGS. 8 and 9, in one embodiment of the invention, a first metal rod 168 has its upper end welded to the underside of leg 160 as to be depending downwardly therefrom, as generally depicted, and a second rod 170 similarly has its upper end welded to the underside of leg 160. As should be apparent, rods 168 and 170 are, at least for the most part, encased within the material forming the body section 87. As also illustrated, first and second generally horizontally disposed rods 172 and 174 have their respective left ends welded to the upstanding leg 162 of bracket 158, while a third horizontal rod 176 has its left end welded as to downwardly depending rod 168. As can be seen, rods 172, 174 and 176 are, for the most part, encased within the material forming the body section 89.

Further, as best shown in FIG. 9, additional reinforcing rods 178, 180 and 182 have their right-most ends respectively welded to rods 172, 174 and 176 with such rods 178, 180 and 182 being encased in the material forming body section 85. Also, similar reinforcing rods 184, 186 and 188 have their left-most ends respectively welded to rods 172, 174 and 176 as to thereby be encased within the material forming body section 84.

Figure 10:
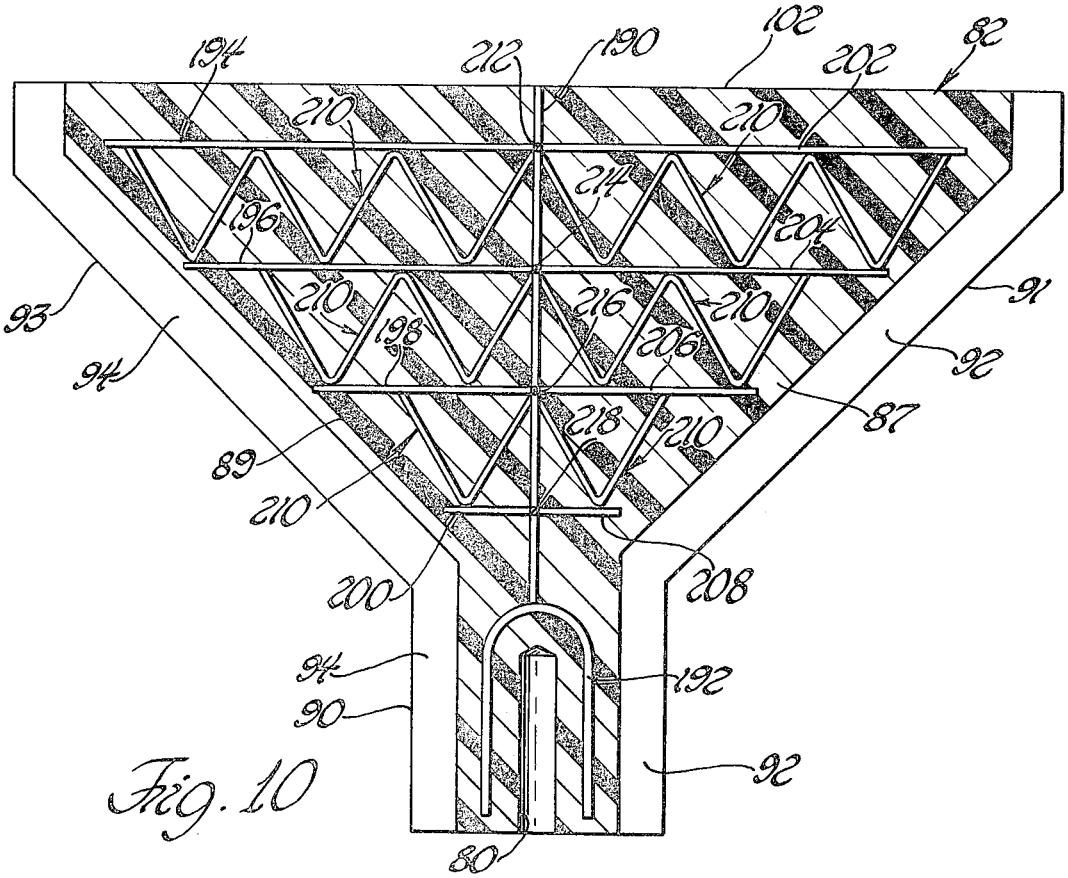
FIG. 10 is an enlarged view taken generally on the plane of line 10—10 of FIG. 6 and looking in the direction of the arrows.

FIG. 10 is an enlarged view of a further embodiment of the invention with such view being as if taken, for purposes of reference, on the plane of line 10—10 of FIG. 6. As can be seen, a vertically extending rod 190 is suitably secured, as by welding, to an inverted U-shaped reinforcing member 192 at the lower end thereof. A first plurality of generally horizontally disposed reinforcing rods 194, 196, 198 and 200 have their respective right ends welded to the vertical rod 190 while a second plurality of generally horizontally disposed reinforcing rods 202, 204, 206 and 208 have their respective left ends welded to the vertical rod 190. Also, as shown, inclined cross-bracing means 210 are also welded to upper and lower disposed horizontal reinforcing rods as to thereby form truss means. (For purposes of clarity, the various reinforcing rods and bracing means have not been shown in cross-hatching.) In addition to the reinforcing rods and bracing means shown as being encased within body sections 89 and 87, similar reinforcing rods and bracing means are also provided within body sections 84 and 85. A portion of such reinforcing rods as would be encased within body section 85 are shown in cross section at 212, 214, 216 and 218; the reinforcing rods encased within body section 84 would, preferably, be in line with such rods 212, 214, 216 and 218 and also welded to vertical rod 190.

Figure 11:
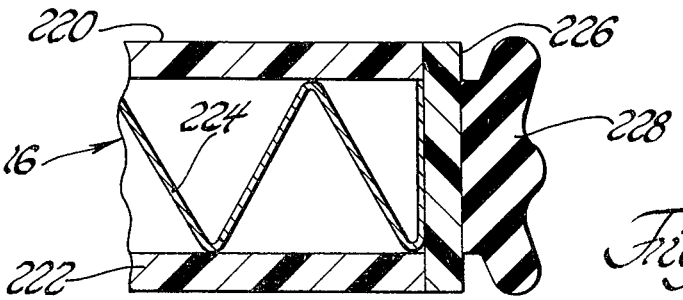
FIG. 11 is an enlarged fragmentary cross-sectional view taken generally on the plane of line 11—11 of FIG. 3 and looking in the direction of the arrows.

FIG. 11, an enlarged fragmentary cross-sectional view taken generally on the plane of line 11—11 of FIG. 3, illustrates that in the preferred embodiment, the wall panel 16 is preferably formed of opposed sheet-like wall surfaces 220 and 222 between which suitable core means 224 is situated. The periphery of the entire panel 16 may, in turn, be defined as by a suitable edging member 226 which may be secured to the wall sheets 220 and 222 by any suitable means as, for example, by cementing. Further, in the preferred embodiment, sheets 220 and 222 as well as edge member 226 are formed of plastic material having a relatively low rate of thermal conductivity. Although not absolutely essential, nevertheless, it is contemplated that because of manufacturing tolerances as well as the selection of relative dimensions for ease of assembly, the various coacting elements may not, in and of themselves, achieve a tight interfit. Therefore, in order to enhance such interfits and prevent air and moisture leakage, suitable sealing means such as a functionally continuous resilient deflectable seal 228 may be affixed to the edge of panel 16 as to extend, for example, along edges 64, 60, 51, 50, 58, 52, 53, 62 and 66.

As also depicted in FIG. 3, the actual wall forming panel means 16 may, in fact, be formed of separate panel sections 16*a*, 16*b* and 16*c* which can be situated atop each other defining, for example, juncture lines 230 and 232.

Figure 13:
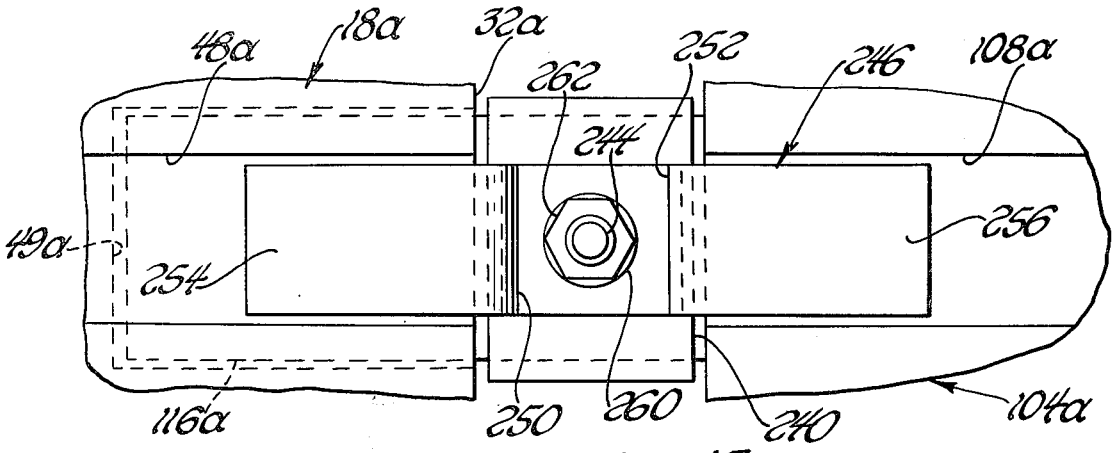
FIG. 13 is a view taken generally on the plane of line 13—13 of FIG. 12 and looking in the direction of the arrows.
Figure 12:
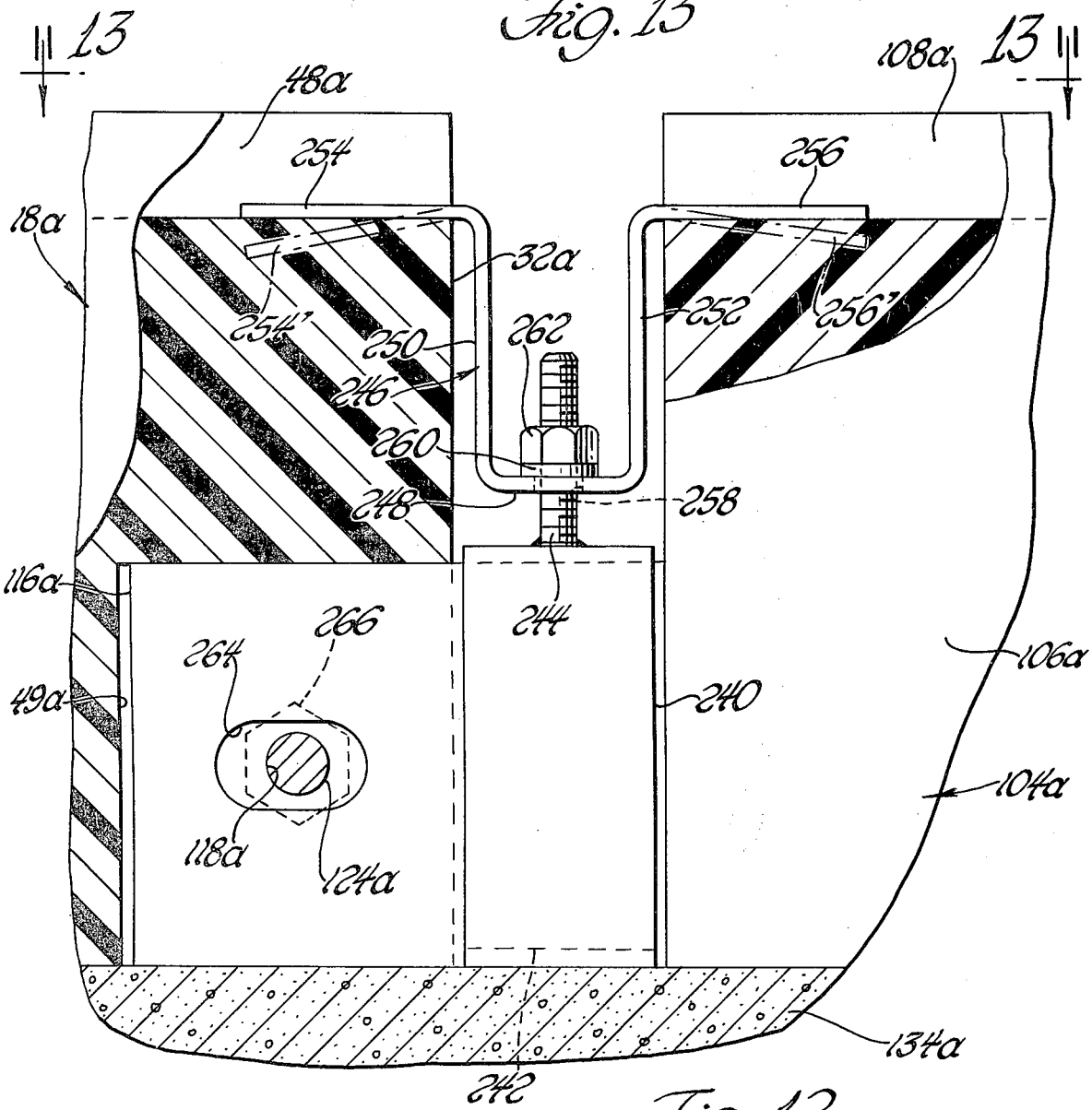
FIG. 12 is an enlarged fragmentary view, partly in cross-section, of a further modified form of certain of the elements shown in, for example, FIG. 3.

FIGS. 12 and 13, in relatively enlarged and fragmentary view, illustrate a further modification of the invention. All elements in FIGS. 12 and 13 which are like or similar to those of preceding Figures are identified with like reference numbers provided with a suffix *a*.

As typically illustrated in FIGS. 12 and 13, each of the extension portions or tongue-like members 116*a* of the base member 104*a* is preferably provided with metal band or strap 240 generally circumscribing the extension 116*a*. The lower portion of strap means 240 may be received within a transversely extending groove or recess 242 formed within the underside of extension 116*a*. A suitable threaded stud 244 may be welded or otherwise secured to the top of strap 240 as to be generally upwardly directed therefrom.

Clamping means, in the form of a bracket 246 having a bight portion 248 joining upwardly extending legs 250, 252 and integrally formed arm portions 254, 256, has an aperture 258 formed through the bight portion 248 as to therethrough accommodate the passage of stud 244. Preferably, clamping bracket 246 is formed of relatively resilient material as to, in its free state, have arms 254 and 256 assume somewhat downwardly inclined positions as generally depicted in phantom lines at 254′ and 256′.

In any event, when the base member 104*a* is connected to column 18*a*, tongue-like extension 116*a* received within slot or recess 49*a* as to cause stud 244 to be situated generally in the space between juxtaposed end surfaces of column 18*a* and base 104*a*. Clamp bracket 246 is then placed into position so that stud 244 extends through aperture 258 and arms 254 and 256 are respectively received within grooves 48*a* and 108*a*. A washer 260 and nut 262, operatively connected to stud 244, are then tightened against bight portion 248 until the base member 104*a* is effectively vertically locked against and with the cooperating column 18*a*. As in previous Figures, wall panel means 16 would then be received within aligned grooves 48*a* and 108*a*. It should, of course, be apparent that any space existing between juxtaposed end surfaces of column foot portion 32*a* and body 106*a* of base 104*a* may be covered or filled with any suitable material including, for example, a fluid plastic material which, for example, could be thermoplastic.

If desired, after base 104*a* and column 18*a* have been clamped, a bolt 124*a*, or its equivalent, may be inserted through apertures 118*a* formed in the foot portion and through an elongated aperture 264 formed in the extension 116*a* and then tightened as by a cooperating nut 266.

Although only a preferred embodiment and a select number of other embodiments and modifications of the invention have been disclosed and described, it is apparent that still other embodiments and modifications of the invention are possible within the scope of the appended claims.

I claim:

1. A building structure, comprising a plurality of generally vertically extending spaced column means, groove-like recess means formed in said column means and extending generally longitudinally thereof, said groove-like recess means having at least a major portion thereof inclined with respect to the vertical, and a plurality of wall panel means separate from said column means, said plurality of wall panel means being adapted to be respectively received between said spaced column means and at least partly received within said groove-like recess means formed in said column means to thereby define at least a segment of a wall assembly supported by said column means, said wall panel means comprising first and second oppositely disposed side edges, a first edge portion of said first side edge and a second edge portion of said second side edge also being inclined with respect to the vertical in a manner as to be complementary to the angle of said recess means, said first side edge further comprising a third edge portion, said second side edge further comprising a fourth edge portion, said third edge portion being disposed above said first edge portion and extending vertically upwardly as to define a vertical continuation of said first edge portion, and said fourth edge portion being disposed above said second edge portion and extending vertically upwardly as to define a vertical continuation of said second edge portion.

2. A building structure according to claim 1 wherein said plurality of column means comprises a plurality of column members, wherein one end of said column members is of a relatively small cross-sectional area and wherein an other end of said column members is of a relatively large cross-sectional area, wherein said groove-like recess means are inclined with respect to the vertical so that the end of said groove-like recess means nearest said other end is furthermost disposed from the longitudinal axis of said column member and so that the end of said groove-like recess means nearest said one end is closest to said longitudinal axis.

3. A building structure according to claim 2 wherein at least some of said column members contain axially extending passage means extending from said one end to said other end in order to thereby define a hollow construction.

4. A building structure according to claim 1 wherein said wall panel members are of a trapezoidal configuration.

5. A building structure according to claim 1 and further comprising capping means situated above said wall panel means and said column means and operatively connected thereto, said capping means comprising a capping member of unitary construction extending from and supported by respective juxtaposed support surfaces of respective ones of said spaced column means.

6. A building structure according to claim 5 wherein said capping member is generally interposed between portions of succeeding wall panel means in a manner whereby a top-most edge of said capping member is in general elevational alignment with top-most edges of said succeeding wall panel means.

7. A building structure according to claim 1 and further comprising a plurality of base members, said plurality of base members being respectively interposed between said spaced plurality of column members and operatively interconnecting succeeding ones of said column members, said base members being effective to undergo tension stresses running generally between said succeeding ones of said column members whenever said wall panel means are assembled thereto and received within said groove-like recess means.

8. A building structure according to claim 7 and further comprising aperture means formed through said base members, said aperture means being effective to receive therein anchoring means for anchoring said base members to support structure situated beneath said base members and to permit a limited degree of movement of said base members relative to said support structure.

9. A building structure according to claim 7 wherein said base members comprise additional groove-like recess means formed therein effective for the reception of an end edge of respective ones of said plurality of wall panel means, said additional groove-like recess means being in effective alignment with said first mentioned groove-like recess means as to form a functional continuation thereof as between said succeeding ones of said column means.

10. A building structure according to claim 1 wherein said column means comprise a plurality of column members, said column members each further comprise a plurality of foot portions formed thereon, said foot portions extending generally radially outwardly of the longitudinal axis of said column member, additional groove-like recess means formed in said foot portions as to define continuations of said first mentioned groove-like recess means and extend generally radially outwardly thereof, and a plurality of base members respectively situated between juxtaposed ones of said foot portions and interconnecting said juxtaposed ones of said foot portions.

11. A building structure according to claim 1 and further comprising capping means situated above said column means and above portions of said wall panel means, said capping means being operatively connected to both said wall panel means and said column means, and an associated roof structure situated atop said capping means and supported thereby.

12. A building structure according to claim 1 and further comprising resilient sealing means interposed between cooperating edges of said wall panel means and said groove-like recess means, said sealing means being fixedly carried by said wall panel means and resiliently deflectable within said groove-like recess means.

13. A building structure according to claim 1 wherein said column means comprises a plurality of column members, and further comprising locating pin means fixedly carried by and projecting from the tops of at least certain of said column members, said locating pins being effective for enabling related structural elements to be slidingly guided thereby into a joining relationship with said column members.

14. A building structure, comprising a plurality of generally vertically extending spaced column members, groove-like recess means formed in said column members and extending generally longitudinally thereof, a plurality of wall panel members separate from said column members, said plurality of wall panel members being adapted to be respectively received between said spaced column members and at least partly received within said groove-like recess means formed in said column members to thereby define at least a segment of a wall assembly supported by said column members, said column members comprising foot portions formed thereon, said foot portions extending generally radially outwardly of the longitudinal axis of said column member, and a plurality of base members, said plurality of base members being respectively interposed between said plurality of spaced column members, said base members being effective to operatively connect to said foot portions and thereby interconnect succeeding ones of said column members, said foot portions further comprising slot means formed in only the underside of said foot portions and extending generally horizontally therealong, and said base members comprising opposed tongue-like projections adapted for the respective reception within said slot means.

15. A wall structure, comprising at least first and second generally extending spaced column members, said first column member comprising a first upper end and a first lower base portion, said second column member comprising a second upper end and a second lower base portion comprising a generally laterally extending first flange-like portion, said second lower base portion comprising a generally laterally extending second flange-like portion, said first lower base portion and said second lower base portion each being effective to be vertically supported by associated lower disposed support surface means, and a base member for interconnecting said first flange-like portion and said second flange-like portion, said base member comprising body means, said body means comprising a lower surface effective to be vertically supported on said support surface means, oppositely disposed first and second connecting ends carried by said body means, and mechanical clamping means effective for clamping said first and second connecting ends respectively to said first and second flange-like portions, said clamping means being effective to apply a generally vertically directed clamping force as against said flange-like portions and said connecting ends.

16. A wall structure according to claim 15, and further comprising a first upper surface carried by said first flange-like portion, a first undersurface formed on said first flange-like portion as to be juxtaposed to said support surface means, a slot formed in said first lower base portion through said undersurface as to define a generally laterally extending upper slot end surface generally between said undersurface and said first upper surface, wherein said first connecting end comprises a generally laterally extending upper disposed abutment surface, wherein said first connecting end is received by said slot, and wherein said clamping means is effective to force said abutment surface toward said upper slot end surface.

17. A wall structure according to claim 16 wherein said clamping means comprises a first clamp member secured to said first connecting end, a second upwardly situated clamp member effective for operatively engaging clamping portions of said first flange-like portion and said base member, and means for forcing said first and second clamp members toward each other.

18. A wall structure according to claim 16 wherein said clamping means comprises an anchoring band situated generally about said first connecting end, a threaded stud secured to said anchoring band and extending generally upwardly therefrom, and clamping arm means operatively connected to said stud, said clamping arm means being effective to operatively engage said base member and said first flange-like portion from above as to apply a downward force thereagainst.

19. A wall structure according to claim 15 wherein said clamping means comprises a first clamp member secured to said first connecting end, a second upwardly situated clamp member effective for operatively engaging clamping portions of said first flange-like portion and said base member, and means for forcibly drawing said first clamp member and said second clamp member toward each other.

20. Structural load bearing capping means for use atop associated structural column means, comprising a capping body, said capping body comprising at least three body sections angularly spaced from each other and generally extending in a cantilevered fashion from a common juncture-like midportion, and downwardly directed mounting surface means situated generally below said midportion, said downwardly directed mounting surface means being effective to be operatively placed atop said associated structual column means as to be vertically supported thereby.

21. Structural load bearing capping means according to claim 20 wherein said capping body is formed of non-metallic material, and further comprising strength reinforcing members situated within said capping body as to be effectively encased within said material.

22. Structural load bearing capping means according to claim 21 wherein said material comprises a resin-based plastic material.

23. Structural load bearing capping means according to claim 20 wherein at least one of said three body sections comprises a stepped surface formed therein, and wherein said stepped surface is adapted to support thereon associated roof joist means.

24. Structural load bearing capping means according to claim 23 and further comprising metal reinforcing means situated along said stepped surface.

* * * * *